US005174672A

United States Patent [19]

Towsend

[11] Patent Number: 5,174,672

[45] Date of Patent: Dec. 29, 1992

[54] SHORT PEN HAVING A RELATIVELY LONG CAP

[76] Inventor: Marvin S. Towsend, 8 Grovepoint Ct., Rockville, Md. 20854

[21] Appl. No.: 767,618

[22] Filed: Sep. 30, 1991

[51] Int. Cl.[5] ..... B43K 23/02

[52] U.S. Cl. ..... 401/6; 401/88; 401/131

[58] Field of Search ..... 401/6-8, 401/34, 35, 20, 21, 88, 202, 213, 131; 132/74.5

[56] References Cited

U.S. PATENT DOCUMENTS

| | | | |
|---|---|---|---|
| D. 120,108 | 4/1940 | Lipic . | |
| D. 128,985 | 8/1941 | Weiss . | |
| D. 160,670 | 10/1950 | Stern . | |
| D. 202,843 | 11/1965 | Dales | D19/44 X |
| D. 206,735 | 1/1967 | Levy . | |
| D. 207,563 | 5/1967 | Bailey . | |
| 271,872 | 0/0000 | Knapp . | |
| D. 276,479 | 11/1984 | Mori | D19/43 X |
| 300,693 | 6/1884 | Collard . | |
| D. 303,991 | 10/1989 | Murphy | D19/43 X |
| D. 306,177 | 2/1990 | Park . | |
| D. 310,542 | 9/1990 | Regnault . | |
| D. 317,324 | 6/1991 | Chuang | D19/57 |
| 586,495 | 7/1897 | Hicks . | |
| 945,026 | 1/1910 | Faust . | |
| 1,339,707 | 5/1920 | Lazarides . | |
| 1,568,347 | 1/1926 | Shaw | 401/48 |
| 1,598,873 | 9/1926 | Peterson . | |
| 1,615,506 | 1/1927 | Felt . | |
| 1,669,755 | 5/1928 | Hopper . | |
| 1,678,505 | 7/1928 | Gregory | 401/82 |
| 1,718,831 | 6/1929 | Nordrum . | |
| 1,763,327 | 6/1930 | Richie . | |
| 1,780,527 | 11/1930 | Kolber | 401/243 X |
| 1,859,775 | 5/1932 | Hyams . | |
| 2,528,921 | 11/1950 | Swanson . | |
| 2,673,362 | 3/1954 | Robinson | 401/202 X |
| 2,826,175 | 3/1958 | O'Connell | 401/6 |
| 3,174,461 | 3/1965 | Pompa . | |
| 3,688,450 | 9/1972 | Brockman | 401/34 X |
| 4,149,812 | 4/1979 | Huffman . | |
| 4,602,885 | 7/1986 | Bischoff et al. . | |
| 4,974,982 | 12/1990 | Nielson | 401/243 |

OTHER PUBLICATIONS

Eberhard Faber Catalog., 1907, pp. 28 and 29.

*Primary Examiner*—Danton D. DeMille
*Attorney, Agent, or Firm*—Marvin S. Towsend

[57] ABSTRACT

A ball point pen and removable cap combination includes a ball point pen assembly and a removable cap that has a clip/writing-stabilizer portion extending away from the closed end and the open end of the cap. The ball point pen assembly includes a point portion and a barrel portion. The removable cap is capable of sliding longitudinally and fitting by a friction fit onto the barrel portion, on the barrel end opposite the point, when the ball point pen assembly is used for writing, forming a pen-cap combination. In this way, the removable cap can rest upon the skin of the hand between the uppermost joint of the index finger and the uppermost joint of the thumb when the ball point pen assembly is used for writing. Also, when the pen assembly is used for writing, the clip/writing-stabilizer portion extends towards the pen point and is in the vicinity of the pen point, whereby the index finger and the thumb of the user are in contact with the clip/writing-stabilizer portion when the user is writing with the pen-cap combination. The removable cap has a first length from a closed end to an open end. The barrel portion has a second length from one end of the barrel to the other. The first length is at least 50% of the second length, providing a short pen having a relatively long cap, giving the appearance of a baby or midget pen.

10 Claims, 2 Drawing Sheets

SHORT PEN HAVING A RELATIVELY LONG CAP

FIELD OF THE INVENTION

The present invention relates to the field of writing implements such as pens, especially ball point pens.

BACKGROUND OF THE INVENTION

Ball point pens and fountain pens are very popular writing implements. When a ball point pen or a fountain pen is carried by a garment worn by a person, such as in a garment pocket, ink from the tip of the pen can stain the garment. To prevent ink stains, a pen may be provided with a retractable tip (for a ball point pen). Alternatively, a removable cap may be provided to be slid longitudinally over the pen tip and fit by friction to the pen, covering the pen tip when the pen is not in use, such as when the pen is carried in a pocket (for both ball point pens and fountain pens). Customarily, the removable cap can be slid longitudinally over the back end of the pen and be retained by friction between the cap and the back end of the pen when the pen is used for writing.

A recent sampling of the marketplace reveals that ball point pens, having removable, friction-fitting caps that are slid longitudinally over the back ends of the pens, are generally five to six inches in length. When the removable, friction-fitting cap is not being carried by the pen, the length of the barrel of the pen, from just behind the pen tip to the opposite end of the pen is just slightly less in length than the overall length of the pen. Such a conventional barrel length permits the pen to be held in a conventional way, that is grasped by a user's fingers, when the pen is used for writing.

Generally, when a person uses a pen for writing, the thumb and first two fingers of the writer's hand grasp the barrel of the pen behind the pen tip. A portion of the pen barrel rests on the skin of the hand between the uppermost joint of the index finger and the uppermost joint of the thumb. When a pen having such a barrel has a removable, friction-fitting cap, and the pen is to be used for writing, the removable cap is slid longitudinally over the back end of the pen and is retained on the pen by a friction fit. Because the pen barrel is sufficiently long, the removable cap is carried by the back end of the pen without contacting the skin of the hand between the uppermost joint of the index finger and the uppermost joint of the thumb.

Several problems, however, can arise from the use of conventional pens. If a person would like to carry a pen within a front pants pocket that spans articulated body parts (e.g. a lower portion of the abdomen and a thigh), there are a number of undesirable results that occur if the pen is oriented in a substantially vertical orientation inside the front pants pocket. For one thing, a long vertical bulging line may be visible from outside the front pocket. Such a bulging line may not be pleasing aesthetically to an observer. Also, when a person crouches down, by bending one's legs with respect to one's hips and abdomen, a long stiff pen in a vertical orientation inside the front pants pocket would make the crouching down uncomfortable. More specifically, when one crouches down, it is natural for the front pants pocket to be bent along the crease between the abdomen and the leg. If a long, vertical pen is inside a front pants pocket, such a pen may prevent the pocket from adequately bending along that crease. Also, when the wearer crouches down, an abnormally large amount of pressure may be exerted by the conventional pen on the inside surface of the pocket causing accelerated wear of the pocket, perhaps resulting in a hole being punched in the pocket. These problems would be exaggerated in case the pants fit the wearer tightly.

Moreover, a conventional pen having a removable, friction-fitting cap may very well exceed the vertical depth of a front pants pocket. Many front pants pockets are less deep than five inches. Such a pen would unaesthetically protrude from the pocket.

The conventional pen that is five inches long or longer is generally too long to fit into a front pants pocket in a horizontal orientation. This is so because many front pants pockets are considerably less in width than five inches. More specifically, the width of many front pants pockets is in a range of from three to four and one half inches.

If a five inch or longer pen having a removable, friction-fitting cap were placed in a vertical orientation in a rear pants pocket, another problem would occur. If a person bends down into a crouch, the pants generally tighten around the rounded surface of the wearer's rear end. The round profile of the person's rear end would be resisted by the straight vertical pen. This could cause discomfort, appear unaesthetic, and cause unwanted stress on the pocket, possibly resulting in a tear to the pocket.

And, as stated above with respect to the front pants pocket, the conventional pen that is five inches long or longer is generally too long to fit into a rear pants pocket in a horizontal orientation. This is so because many rear pants pockets are considerably less in width than five inches. More specifically, the width of many rear pants pockets is in a range of from three to four and one half inches.

Customarily, conventional pens that are five inches long or longer are worn in a vertical orientation in a breast shirt pocket or breast coat pocket. And customarily, these conventional pens are so long that they stick out the top of the breast shirt pocket or breast coat pocket. Aside from an unaesthetic appearance, another common problem associated with such pens is that the pen falls out of the pocket and onto the floor or ground when the person leans forward.

In sharp contrast, theoretically, a pen that could be retained in a breast shirt pocket or breast coat pocket in a horizontal orientation would fall, under gravity, to the bottom of the pocket. When a person would lean forward, the top of the breast shirt pocket or breast coat pocket, being free from interference by a pen that sticks out vertically from the top of the pocket, would tend to tighten and would tend to form a seal preventing the contents of the pocket from spilling out of the pocket. Thus, theoretically, a pen that would be retained horizontally in a breast shirt pocket or breast coat pocket would be virtually immune from falling out of the pocket if the person leans forward.

However, the conventional pen that is five inches long or longer is generally too long to fit into a breast shirt pocket or breast coat pocket in a horizontal orientation. This is so because many breast shirt pocket or breast coat pockets are considerably less in width than five inches. More specifically, the width of many breast shirt pockets or breast coat pockets is less than four and one half inches. It would be desirable, therefore, if a pen could be devised that could fit horizontally in a breast shirt pocket or breast coat pocket.

The conventional five inch or longer pen is also too long to be worn comfortably by the wearer when it is clipped onto a wearer's belt in front of the wearer. Such a long pen, when worn on a wearer's belt in front of the wearer, would interfere with the wearer's bending when the wearer's torso is bent with respect to the wearer's hips.

Many pants products are equipped with small, shallow watch pockets located near the top of a conventional pocket. A conventional five inch or longer pen is too long to fit comfortably into such a shallow pocket.

It is pointed out that an unaesthetic appearance of a conventional pen when retained in a vertical orientation in a pocket may be a significant deterrent to a person to carry such a pen in manner on one's person. Because of the undesirable appearance of such a conventional pen, a person may deprive oneself of the convenience and utility of having a pen readily available on one's person. When such a person would need a pen, the person may have to go hunting for a pen, especially when the person is away from one's home or office.

SUMMARY OF THE INVENTION

Accordingly, it is an object of the present invention to provide a small pen having a removable, friction-fitting cap that can readily fit into a front or rear pants pocket in a horizontal orientation.

Another object of the present invention is to provide a relatively short pen that has means for extending the pen length to the skin of the hand between the uppermost joint of the index finger and the uppermost joint of the thumb.

Yet another object of the present invention is to provide a relatively short pen that can conveniently clip onto a wearer's belt, in front of the wearer, and not interfere with the wearer's bending when the wearer's torso is bent with respect to the wearer's hips.

Still another object of the present invention is to provide a relatively short pen that can comfortably fit into a small, shallow watch pocket located near the top of a conventional pants pocket.

Another object of the present invention to provide a small pen having a removable, friction-fitting cap that can readily fit into a breast shirt pocket or breast coat pocket in a horizontal orientation.

Yet another object of the present invention is to provide a small pen that precludes an unaesthetic appearance of a pen when retained in a vertical orientation in a pocket, thereby precluding a person from being deterred from carrying a pen on one's person, thereby precluding the person from being deprived of the convenience and utility of a pen carried on one's person.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved writing implement is provided for use by a person's hand which has an uppermost joint of an index finger, an uppermost joint of a thumb, and skin between the joints. The novel writing implement of the invention includes an implement assembly and a removable cap, which, together form a pen-cap combination of the invention when a pen is the writing implement.

The implement assembly includes a point portion and a barrel portion. The barrel portion has a first end adjacent to the point portion and has a second end opposite to the point portion. The implement assembly has a length which is too short for the barrel portion to rest upon the skin of the hand between the uppermost joint of the index finger and the uppermost joint of the thumb when the implement assembly is used for writing.

The novel writing implement of the invention, such as the novel pen-cap combination, also includes a removable cap capable of sliding longitudinally onto the first barrel end and fitting by a friction fit onto the first barrel end and covering the point portion of the implement assembly when the implement assembly is not used for writing.

The removable cap, when removed from the first barrel end, is also capable of being slid longitudinally onto the second barrel end and fitting by a friction fit onto the second barrel end when the implement assembly is used for writing, such that the removable cap can rest upon the skin of the hand between the uppermost joint of the index finger and the uppermost joint of the thumb when the implement assembly is used for writing.

Thus, with the pen-cap combination of the invention, the removable cap serves two distinct purposes. First, when the pen-cap combination is not used for writing, the removable cap covers the pen point. And, second, when the pen-cap combination is used for writing, the removable cap extends the length of the short pen so that the pen-cap combination is long enough for a portion of the removable cap to rest upon the skin of the hand between the uppermost joint of the index finger and the uppermost joint of the thumb, whereby the pen-cap combination is stabilized as the person writes.

The removable cap includes a closed end and an open end. Preferably, the removable cap includes a clip portion that extends away from both the open end and the closed end of the removable cap. With conventional pens, as with the pen-cap combination of the invention, the clip portion is used to secure the pen and cap combination to an edge of a pocket, belt, belt loop, or the like.

With the invention, however, in addition to its conventional use, the clip can be positioned over the barrel portion and squeezed between two fingers (which can be a finger and a thumb) and thereby be used to stabilize the pen-cap combination with respect to the fingers when the removable cap is fitted onto the second barrel end when the pen-cap combination is used for writing.

In accordance with another aspect of the invention, a method is provided for making a writing implement, such as a ball point pen. In the method, a relatively short cap free writing implement is obtained. The short writing implement has two ends, a point end and an end opposite the point. When the short cap free writing implement is grasped by a user for writing, the short cap free writing implement is not long enough for a portion thereof to rest upon the skin of the user's hand between the uppermost joint of the index finger and the uppermost joint of the thumb. After obtaining the relatively short cap free writing implement, a sufficiently long removable cap is obtained and friction fitted to the end of the cap free writing implement opposite the point, such that the combination of the cap free short writing implement and the removable cap fitted to the cap free writing implement is long enough for a portion of the removable cap to rest upon the skin of the hand between the uppermost joint of the index finger and the uppermost joint of the thumb.

Still other objects of the present invention will become readily apparent to those skilled in this art from the following description, wherein there are shown and described several preferred embodiments of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF PREFERRED EMBODIMENTS

Figure 1:
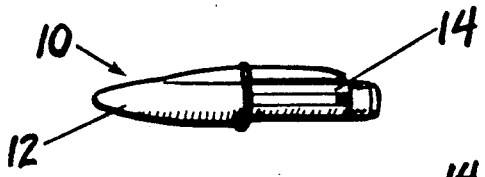
FIG. 1 is a side elevational view of one embodiment of a pen-cap combination of the invention wherein the removable cap is fitted onto the barrel and covers the point of the pen.
Figure 2:
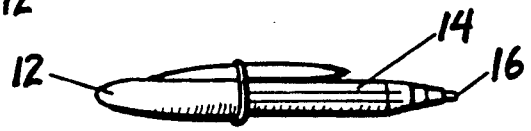
FIG. 2 is a side elevational view of the embodiment in FIG. 1 wherein the removable cap is fitted onto the opposite end of the barrel leaving the point exposed for writing.
Figure 3:
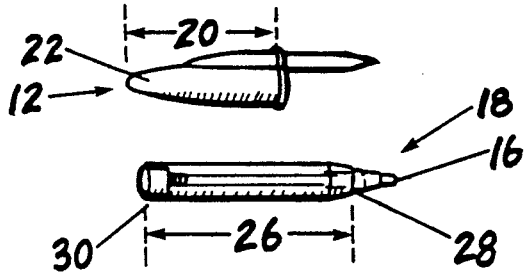
FIG. 3 is a side elevational view of the embodiment shown in FIG. 1 wherein the removable cap is removed from the barrel and is placed along side the barrel for purposes of dimensional comparison.

With reference to FIG. 1, one embodiment of a pen-cap combination 10 of the invention is shown wherein a removable cap 12 has been slid longitudinally onto the barrel 14, is fitted by a friction fit onto the barrel 14, and covers the point 16 of the pen 18 (also see FIGS. 2 and 3). The overall length of the pen-cap combination of the invention shown in FIG. 1, showing the closed configuration for retention in a pocket, is approximately 2.75 inches.

In FIG. 2, the embodiment of the pen-cap combination 10 in FIG. 1 is shown wherein the removable cap 12 has been slid longitudinally onto the opposite end of the barrel 14 and is fitted by a friction fit onto the opposite end of the barrel 14 leaving the point 16 exposed for writing. The overall length of the pen-cap combination of the invention shown in FIG. 2, showing the open configuration for writing, is approximately 3.5 inches.

In FIG. 3, the embodiment of the pen-cap combination 10 in FIG. 1 is shown wherein the removable cap 12 is removed from the barrel 14 of the pen 18 and is placed along side the barrel 14 for purposes of dimensional comparison. More specifically, in the pen-cap combination 10, the removable cap 12 has a first length 20 from a closed end 22 to an open end 24. The barrel 14 has a second length 26 from the first barrel end 28 to the second barrel end 30. The length 20 of the removable cap 12, and the length 26 of the barrel 14 are drawn to scale. In FIG. 3, the length 20 is approximately 1.5 inches, and the length 26 is approximately 2.0 inches. The predetermined ratio of length 20 to length 26 in FIG. 3 is 1.5/2.0 which is equal to 75%. It is clear that the first length 20 in the embodiment shown in FIG. 3 is equal to at least two thirds of the second length 26.

Figure 4:
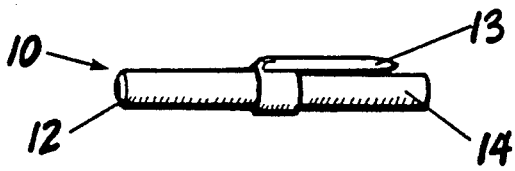
FIG. 4 is a side elevational view of a second embodiment of a pen-cap combination of the invention wherein the removable cap is fitted onto the barrel and covers the point of the pen.
Figure 5:
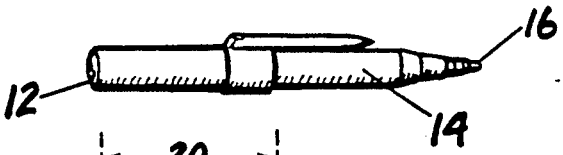
FIG. 5 is a side elevational view of the embodiment in FIG. 4 wherein the removable cap is fitted onto the opposite end of the barrel leaving the point exposed for writing.
Figure 6:
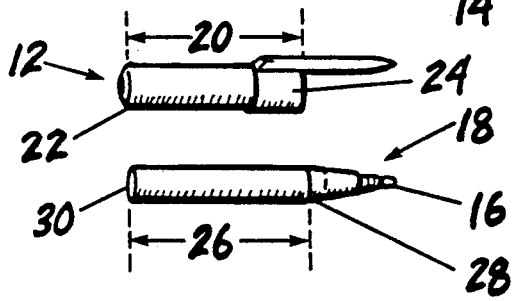
FIG. 6 is a side elevational view of the embodiment shown in FIG. 4 wherein the removable cap is removed from the barrel and is placed along side the barrel for purposes of dimensional comparison.

With reference to FIG. 4, a second embodiment of a pen-cap combination 10 of the invention is shown wherein a removable cap 12 has been slid longitudinally onto the barrel 14, is fitted onto the barrel 14 by friction, and covers the point 16 of the pen 18 (also see FIGS. 5 and 6). The overall length of the pen-cap combination of the invention shown in FIG. 4, showing the closed configuration for retention in a pocket, is approximately 2.9 inches.

In FIG. 5, the embodiment of the pen-cap combination 10 in FIG. 4 is shown wherein the removable cap 12 has been slid longitudinally onto the barrel 14 and is fitted by a friction fit onto the opposite end of the barrel 14 leaving the point 16 exposed for writing. The overall length of the pen-cap combination of the invention shown in FIG. 5, showing the open configuration for writing, is approximately 3.6 inches.

In FIG. 6, the embodiment of the pen-cap combination 10 in FIG. 4 is shown wherein the removable cap 12 is removed from the barrel 14 of the pen 18 and is placed along side the barrel 14 for purposes of dimensional comparison. More specifically, in the pen-cap combination 10, the removable cap 12 has a first length 20 from a closed end 22 to an open end 24. The barrel 14 has a second length 26 from the first barrel end 28 to the second barrel end 30. The length 20 of the removable cap 12, and the length 26 of the barrel 14 are drawn to scale. In FIG. 6, the length 20 is approximately 1.5 inches, and the length 26 is approximately 1.7 inches. The predetermined ratio of length 20 to length 26 in FIG. 6 is 1.5/1.7 which is equal to approximately 88%. It is clear that the first length 20 shown in the embodiment shown in FIG. 6 is equal to at least eight tenths of the second length 26.

Figure 7:
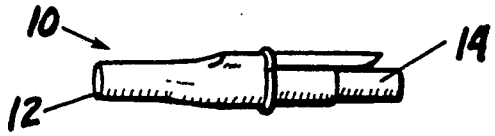
FIG. 7 is a side elevational view of a third embodiment of a pen-cap combination of the invention wherein the removable cap is fitted onto the barrel and covers the point of the pen.
Figure 8:
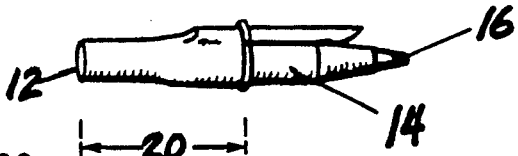
FIG. 8 is a side elevational view of the embodiment in FIG. 7 wherein the removable cap is fitted onto the opposite end of the barrel leaving the point exposed for writing.
Figure 9:
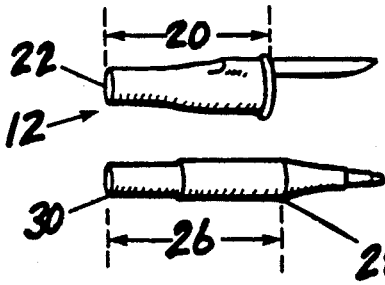
FIG. 9 is a side elevational view of the embodiment shown in FIG. 7 wherein the removable cap is removed from the barrel and is placed along side the barrel for purposes of dimensional comparison.

With reference to FIG. 7, a third embodiment of a pen-cap combination 10 of the invention is shown wherein a removable cap 12 has been slid longitudinally onto the barrel 14, is fitted by a friction fit onto the barrel 14, and covers the point 16 of the pen 18 (also see FIGS. 8 and 9). The overall length of the pen-cap combination of the invention shown in FIG. 7, showing the closed configuration for retention in a pocket, is approximately 2.9 inches.

In FIG. 8, the embodiment of the pen-cap combination 10 in FIG. 7 is shown wherein the removable cap 12 has been slid longitudinally onto the barrel 14 and is fitted by a friction fit onto the opposite end of the barrel 14 leaving the point 16 exposed for writing. The overall length of the pen-cap combination of the invention shown in FIG. 8, showing the open configuration for writing, is approximately 3.25 inches.

In FIG. 9, the embodiment of the pen-cap combination 10 in FIG. 7 is shown wherein the removable cap 12 is removed from the barrel 14 of the pen 18 and is placed along side the barrel 14 for purposes of dimensional comparison. More specifically, in the pen-cap combination 10, the removable cap 12 has a first length 20 from a closed end 22 to an open end 24. The barrel 14 has a second length 26 from the first barrel end 28 to the second barrel end 30. The length 20 of the removable cap 12, and the length 26 of the barrel 14 are drawn to scale. In FIG. 9, the length 20 is approximately 1.5 inches, and the length 26 is approximately 1.6 inches. The predetermined ratio of length 20 to length 26 in FIG. 9 is 1.5/1.6 which is equal to approximately 94%. It is clear that the first length 20 shown in the embodiment shown in FIG. 9 is equal to at least nine tenths of the second length 26.

Figure 10:
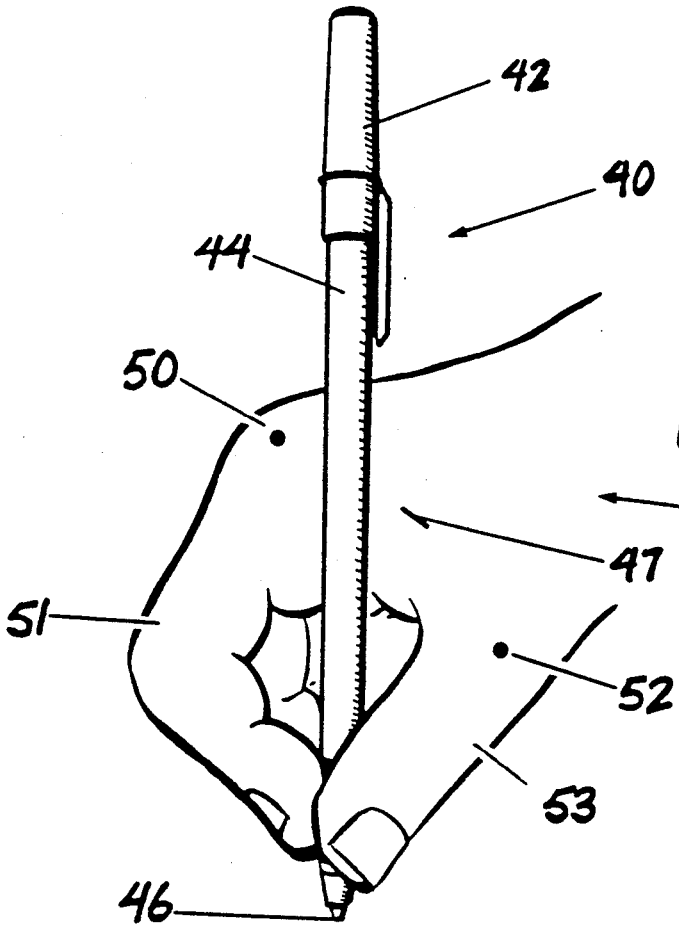
FIG. 10 PRIOR ART
FIG. 10 shows a PRIOR ART pen, held by a hand, having a removable cap fitted onto the barrel of the pen at the end opposite the point.

Turning to FIG. 10, a PRIOR ART pen 40 is shown having a removable cap 42 fitted by a friction fit onto the barrel 44 of the pen at the end opposite the point 46. The pen 40 is being grasped by a hand 48 of a person who is writing with the pen 40. It is noted that the barrel 44 of the pen 40 is in contact with the skin 47 of the hand 48 between the uppermost joint 50 of the index finger 51 and the uppermost joint 52 of the thumb 53.

Figure 11:
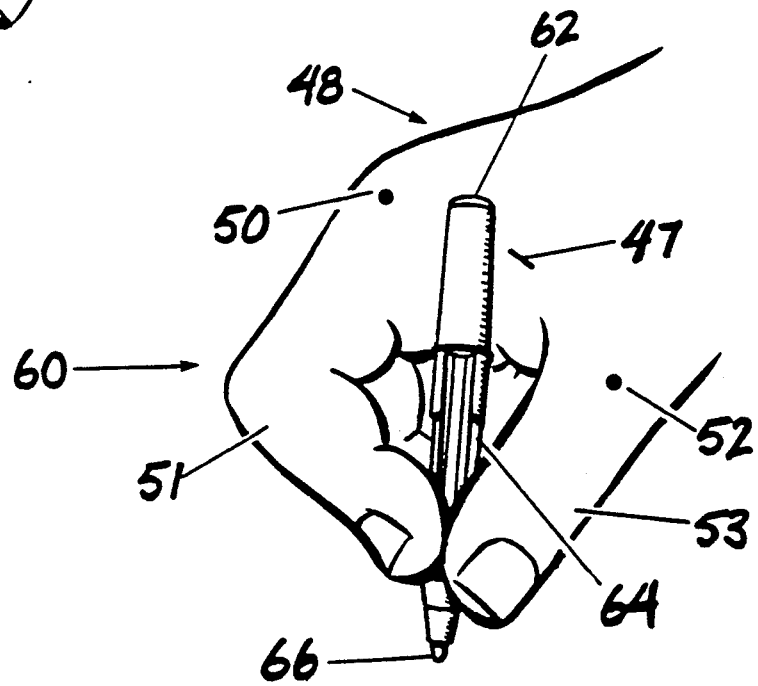
FIG. 11 shows a pen-cap combination of the invention, held by a hand, having a removable cap fitted onto the barrel of the pen at the end opposite the point.

FIG. 11 shows a pen-cap combination 60 of the invention having a removable cap 62 fitted by a friction fit onto the barrel 64 of the pen-cap combination at the end opposite the point 66. The pen-cap combination 60 is being grasped by a hand 48 of a person who is writing with the pen-cap combination 60. The removable cap 62 is resting on the skin 47 of the hand 48 between the uppermost joint 50 of the index finger 51 and the uppermost joint 52 of the thumb 53. The clip/writing-stabilizer portion 13 is in the vicinity of the point 66, and a portion of the clip/writing-stabilizer portion 13 is squeezed between the index finger 51 and the thumb 53, whereby the pen-cap combination is stabilized when used for writing.

For purposes of further discussion, the embodiment of the pen-cap combination 10 of the invention shown in FIGS. 4, 5, 6, and 11 is considered further. However, the principles discussed with respect to this embodiment are applicable to other embodiments of the invention.

The removable cap 12 includes a clip/writing-stabilizer portion 13 that extends away from the open end 24 of the removable cap 12. With conventional pens, as with the pen-cap combination 10 of the invention, the clip/writing-stabilizer portion 13 is used to secure the pen and cap combination to an edge of a pocket, belt, belt loop, or the like (not shown).

In accordance with the invention, as shown in FIG. 11, the clip 13 is positioned over the barrel 64 in the vicinity of the pen point 66 whereby the clip/writing-stabilizer portion can be squeezed between two of a person's fingers when the person is writing to stabilize the writing implement by the two fingers can be squeezed between two fingers (which can be a finger 51 and a thumb 53) and thereby be used to stabilize the pen-cap combination 10 with respect to the fingers 51 and 53 when the removable cap 12 is fitted by a friction fit onto the second barrel end 30 when the pen-cap combination 10 is used for writing.

As shown in FIGS. 2, 5, 8, and 11, when the removable cap 12 is slid longitudinally onto the end of the barrel 14 that is opposite the point (the first end of the barrel) with the cap being fitted by a friction fit onto the barrel leaving the point 16 exposed for writing, the clip/writing-stabilizer portion is positioned over the barrel in the vicinity of said first end of the barrel portion, such that the clip/writing-stabilizer portion can be squeezed between two of a person's fingers when the person is writing with the writing implement, whereby the clip/writing-stabilizer portion can be used to stabilize the writing implement with respect to the two fingers.

Now turning to other aspects of the invention, it is well known that proportions of different parts of a human body change during growth from infancy to adulthood. For example, an infant's head is relatively large with respect to the infant's torso. In contrast, however, an adult's head is relatively small with respect to the adult's torso. As discovered by the present inventor, these anthropomorphic principles relating to head size and torso size can be applied to writing implements, such as pens, in the following way.

One conventional pen is five and one half inches long (without the cap) and has a friction-fitting, removable cap that is a little shorter than one and one half inches long (not including the pocket clip). A second conventional pen is five and one half inches long (without the cap) and has a friction-fitting, removable cap that is a little longer than one and one half inches long (not including the pocket clip). A third conventional pen is six inches long (without the cap) and has a friction-fitting, removable cap that is approximately one and one half inches long (not including the pocket clip). The length of the removable cap of the first conventional pen is approximately 27% the length of the pen. The length of the removable cap of the second conventional pen is also approximately 27% the length of the pen. The length of the removable cap of the third conventional pen is approximately 25% the length of the pen. Thus, the conventional pens studied have caps in a range of 25%-27% the length of the pens. These may be likened to "adult" pens because of the relatively small proportion of the cap (analogous to a person's head) with respect to the body of the pen (analogous to a person's torso).

In contrast with the conventional pens are the pen-cap combinations of the invention. As explained above, for the first embodiment of the invention, shown in FIGS. 1-3, the length of the cap is greater than two thirds (67%) the length of the pen barrel. In fact, for the first embodiment, the length of the cap is approximately 75% the length of the pen barrel.

For the second embodiment of the invention, shown in FIGS. 4–6, the length of the cap is greater than eight tenths (80%) the length of the pen barrel. In fact, for the second embodiment, the length of the cap is approximately 88% the length of the pen barrel.

For the third embodiment of the invention, shown in FIGS. 7–9, the length of the cap is greater than nine tenths (90%) the length of the pen barrel. In fact, for the third embodiment, the length of the cap is approximately 94% the length of the pen barrel.

Thus, for embodiments of the invention described above, the lengths of the caps are in a range of 75%–94% the lengths of the barrels of the pens. The pen-cap combinations of the invention may thus be likened to "baby" or "midget" pens because of the relatively large proportion of the length of the cap with respect to the length of the body of the pen. The appearance of the baby or midget pen is aesthetically pleasing to many people.

The range for the predetermined ratio of the length of the removable cap to the length of the body of the pen-cap combination can be easily be extended to a range of 50%–100% or more to retain the appearance of a baby or midget pen-cap combination. More generally, the length of the removable cap can be at least 50% of the length of the body of the pen-cap combination.

A stated above, the writing implement of the invention can take the form of a ball point pen. Writing implements of the invention can also be in the form of fountain pens, felt tip markers, felt tip pens, crayons, wax pencils, lead pencils, and the like.

The removable cap and the implement barrel can be made from a variety of materials including, preferably, plastic materials.

Numerous benefits are obtained by employing the principles of the invention. For example, the present invention provides a small pen having a removable, friction-fitting cap, wherein the pen can readily fit into a front or rear pants pocket in a horizontal orientation. The horizontal orientation for the pen-cap combination of the invention in the pocket is desirable because a person's radius of curvature adjacent to a pocket does not change appreciably along a horizontal axis when a person bends forward or crouches down. This constancy of radius of curvature along a horizontal axis is in sharp contrast to the appreciable changes in a person's radius of curvature adjacent to a pocket along a vertical axis when the person bends forward or crouches down. When the pen-cap combination of the invention is in a horizontal orientation in a pocket, the pen-cap combination of the invention is nearly immune from experiencing or exerting additional stresses on the person or on the person's pocket when the person bends or crouches down.

As stated above, the width of pants pockets (front or rear) is often in a range of 3–4.5 inches. Also, for the three embodiments of the pen-cap combinations of the invention disclosed above, the lengths of the closed embodiments, as shown respectively in FIGS. 1, 4, and 7, are respectively, 2.75, 2.9, and 2.9 inches. Thus, it is clear that each of the disclosed embodiments can readily fit in a pocket in horizontal orientation when the width of the pocket is in a range of 3–4.5 inches.

The present invention also provides a pen-cap combination that can readily fit horizontally in a breast shirt pocket or breast coat pocket.

The present invention also provides a small pen that precludes an unaesthetic appearance of a conventional pen when retained in a vertical orientation in a pocket, thereby precluding a person from being deterred from carrying a pen on one's person, thereby precluding the person from being deprived of the convenience and utility of a pen that is carried on one's person.

The present invention also provides a relatively short pen that has means (a removable cap) for lengthening the short length so that the pen extends to the skin of the hand between the uppermost joint of the index finger and the uppermost joint of the thumb, whereby stability is gained when writing takes place.

The present invention also provides a relatively short pen that can conveniently clip onto a wearer's belt, in front of the wearer, and not interfere with the wearer's bending when the wearer's torso is bent with respect to the wearer's hips.

The present invention also provides a relatively short pen that can comfortably fit into a small, shallow watch pocket located near the top of a conventional pants pocket.

The pen-cap combinations of the invention provide "baby" or "midget" pens because of the relatively large proportion of the length of the cap with respect to the length of the body of the pen. The appearance of the baby or midget pen is aesthetically pleasing to many people.

The foregoing description of the invention has been presented for purposes of illustration and description. It is not intended to be exhaustive or to limit the invention to the precise form disclosed. Furthermore, obvious modifications or variations of the invention are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for making a writing implement, comprising the steps of:

obtaining a relatively short cap-free writing implement that, when grasped by a user for writing, is not long enough for a portion of the cap-free writing implement to rest upon the skin of the user's hand between the uppermost joint of the index finger and the uppermost joint of the thumb, wherein the cap-free writing implement has two ends, a point end and an end opposite the point end, wherein the cap-free writing implement has a barrel having a barrel length;

obtaining a removable cap having an open end and a closed end and further including a clip portion extending away from both the open end and the closed end of the removable cap, the removable cap having a cap length that is in a predetermined ratio to the barrel length, the removable cap characterized such that, when friction fitted to the end of the cap-free writing implement opposite the point end, the removable cap forms a combination writing implement and removable cap that is long enough for a portion of the removable cap to rest upon the skin of the hand between the uppermost joint of the index finger and the uppermost joint of the thumb; and longitudinally sliding the removable cap onto the end of the cap-free writing implement opposite the point end whereby the removable cap is friction fitted onto the end of the cap-free writing implement opposite the point end, whereby a combination writing implement and removable cap is made that is long enough for a portion of the removable cap to rest upon the skin of the hand between the uppermost joint of the index finger and the uppermost joint of the thumb, whereby the clip portion is, by virtue of the predetermined ratio between the cap length and the barrel length, positioned over the barrel portion, permitting squeezing the clip portion between two of the user's fingers when the user is writing with the writing implement, whereby the clip portion can be used to stabilize the writing implement with respect to the two fingers.

2. A writing implement and removable cap combination for use by a person's hand having an uppermost joint of an index finger, an uppermost joint of a thumb, and skin between the joints, the writing implement comprising:

a writing implement assembly which includes a point portion and a barrel portion, said barrel portion having a first end adjacent to said point portion and having a second end opposite to said point portion, said writing implement assembly having a length which is too short for said barrel portion to rest upon the skin of the hand between the uppermost joint of the index finger and the uppermost joint of the thumb when said writing implement assembly is used for writing, and a removable cap capable of sliding longitudinally onto said first barrel end and fitting by a friction fit onto said first barrel end and covering said point portion of said writing implement assembly when said ball point pen assembly is not used for writing, and said removable cap also capable of sliding longitudinally onto said second barrel end and fitting by a friction fit onto said second barrel end when said writing implement assembly is used for writing, such that said removable cap can rest upon the skin of the hand between the uppermost joint of the index finger and the uppermost joint of the thumb when said writing implement assembly is used for writing, wherein said removable cap has a first length from a closed end to an open end, wherein said barrel portion has a second length from said first barrel end to said second barrel end, and wherein said first length to said second length is in a predetermined ratio, wherein said removable cap further includes a clip/-writing-stabilizer portion extending away from both the open end and the closed end of said removable cap, and wherein, said predetermined ratio of said first length to said second length is such that, said clip/writing-stabilizer portion is positioned over said barrel portion in the vicinity of said first end of said barrel portion, such that said clip/writing-stabilizer portion can be squeezed between two of a person's fingers when the person is writing with the writing implement, whereby said clip/writing-stabilizer portion can be used to stabilize the writing implement with respect to the two fingers.

3. A ball point pen and removable cap combination for use by a person's hand having an uppermost joint of an index finger, an uppermost joint of a thumb, and skin between the joints, the ball point pen comprising:

a ball point pen assembly which includes a point portion and a barrel portion, said barrel portion having a first end adjacent to said point portion and having a second end opposite to said point portion, said ball point pen assembly having a length which is too short for said barrel portion to rest upon the skin of the hand between the uppermost joint of the index finger and the uppermost joint of the thumb when said ball point pen assembly is used for writing, and a removable cap capable of sliding longitudinally onto said first barrel end and fitting by a friction fit onto said first barrel end and covering said point portion of said ball point pen assembly when said ball point pen assembly is not used for writing, and said removable cap also capable of sliding longitudinally onto said second barrel end and fitting by a friction fit onto said second barrel end when said ball point pen assembly is used for writing, such that said removable cap can rest upon the skin of the hand between the uppermost joint of the index finger and the uppermost joint of the thumb when said ball point pen assembly is used for writing, wherein said removable cap has a first length from a closed end to an open end, wherein said barrel portion has a second length from said first barrel end to said second barrel end, and wherein said first length to said second length is in a predetermined ratio, wherein said removable cap further includes a clip/-writing-stabilizer portion extending away from both the open end and the closed end of said removable cap, and wherein, said predetermined ratio of said first length to said second length is such that, said clip/writing-stabilizer portion is positioned over said barrel portion in the vicinity of said first end of said barrel portion, such that said clip/writing-stabilizer portion can be squeezed between two of a person's fingers when the person is writing with the writing implement, whereby said clip/writing-stabilizer portion can be used to stabilize the writing implement with respect to the two fingers.

4. The writing implement described in claim 3 wherein said writing implement is a pen.

5. The writing implement described in claim 3 wherein said writing implement is a ball point pen.

6. The writing implement described in claim 3 wherein said predetermined ratio of said first length to said second length is such that said first length is equal to at least two thirds of said second length.

7. The writing implement described in claim 3 wherein said predetermined ratio of said first length to said second length is such that said first length is equal to at least eight tenths of said second length.

8. The writing implement described in claim 3 wherein said predetermined ratio of said first length to said second length is such that said first length is equal to at least nine tenths of said second length.

9. The writing implement described in claim 3 wherein said predetermined ratio of said first length to said second length is such that said first length is in a range of 67%–90% of said second length.

10. The writing implement described in claim 3 wherein said predetermined ratio of said first length to said second length is such that said first length is in a range of 50%–100% of said second length.

* * * * *